US006173719B1

(12) United States Patent
Petit

(10) Patent No.: US 6,173,719 B1
(45) Date of Patent: Jan. 16, 2001

(54) CASE WITH SEALED ROTATABLE RECEPTACLE

(75) Inventor: Robert Petit, Savigny sur Orge (FR)

(73) Assignee: Lir France, Chevilly Larue (FR)

( * ) Notice: Under 35 U.S.C. 154(b), the term of this patent shall be extended for 0 days.

(21) Appl. No.: 09/469,624

(22) Filed: Dec. 22, 1999

(30) Foreign Application Priority Data

Dec. 24, 1998 (FR) ..... 98 16595

(51) Int. Cl.[7] ..... A45D 33/24; A45D 33/00; A45D 27/22; B65D 69/00

(52) U.S. Cl. ..... 132/294; 132/293; 132/915; 206/581; 206/823

(58) Field of Search ..... 132/294, 293, 132/315, 295, 298, 300, 303, 305; 206/581, 823

(56) References Cited

U.S. PATENT DOCUMENTS

| | | | | |
|---|---|---|---|---|
| 2,990,054 | | 6/1961 | Gellman . | |
| 5,638,839 | * | 6/1997 | Montoli | 132/295 |
| 5,735,297 | * | 4/1998 | Litton | 132/294 |
| 5,896,866 | * | 4/1999 | Quennessen | 132/293 |

FOREIGN PATENT DOCUMENTS

| | | |
|---|---|---|
| 29602752 | 6/1997 | (DE) . |
| 9019321 | 1/1997 | (JP) . |
| 9019322 | 1/1997 | (JP) . |
| 9037836 | 2/1997 | (JP) . |
| 9056450 | 3/1997 | (JP) . |
| 9065920 | 3/1997 | (JP) . |
| 9619131 | 6/1996 | (WO) . |

* cited by examiner

*Primary Examiner*—Gene Mancene
*Assistant Examiner*—Robyn Kieu Doam
(74) *Attorney, Agent, or Firm*—Dennison, Scheiner, Schultz & Wakeman

(57) ABSTRACT

The case (1) comprises a cover (2) and a bottom (3) fixed and hinged by means of a first hinge (21), a first closing device (20) for the said cover (2), and contains a sealed receptacle (4) comprising a bottom (7) and side wall (6) fitted with a an airtight cover (5) fitted with a second hinge (51) and a second closing device (50), characterized in that:

a) the said receptacle (4) is a receptacle that can be click fitted/separated in the said case (1) by clipping means;

b) the said receptacle (4) can be clipped such that the said second closing device (50) can be in two different orientations from the said first closing device (20);

such that the user of the said case can orient the said receptacle himself or herself with respect to the said case depending on whether he or she is right handed or left handed, to make it easier to open the said receptacle later.

11 Claims, 2 Drawing Sheets

CASE WITH SEALED ROTATABLE RECEPTACLE

FIELD OF THE INVENTION

This invention relates to the field of cases designed to contain cosmetic products or beauty products, typically makeup powders.

STATE OF THE ART

In general, cases typically comprise:

a hollow cover in which an inside mirror is fitted;

a hollow bottom fitted with a grid or intermediate support for at least one receptacle that will contain the said cosmetic product;

a hinge, forming the connection device between the said cover and the said bottom such that the said cover can rotate and open the said case;

a closing device or any means of locking and unlocking the said cover to or from the said bottom, to open and close the said case, a typical closing device being a push-button.

Many embodiments of makeup cases are known, that may concern one or several components of the case.

Thus, the following is a list of some patents deposited by the applicant:

patent FR 2 661 080 that describes a compact makeup case and closing device;

patent FR 2 701 365 that describes a transformable makeup case;

patent FR 2 725 958 that relates to a case with a flush closing device with assisted opening;

patent FR 2 737 192 that describes a case with a tilting cover fitted with a hinge with flexible tabs;

patent FR 2 755 352 that describes a case with assisted opening;

patent FR 2 755 353 that describes a case with an unlocking and preliminary opening push-button;

patent FR 2 756 155 that describes a makeup case of the type comprising a bottom, an intermediate plate and a cover on which an inside mirror is fitted.

After cosmetic products have been packaged, usually in the form of solid products or possibly very high viscosity non-fluid pastes, an applicator for the said cosmetic products may be added to the case, typically a powder puff in the most frequent case in which the said cosmetic product is a makeup powder, the shape of the powder puff being the same general shape as the case and being placed inside the case between the said mirror and the said receptacle filled with the said cosmetic product. The said powder puff is usually made of a soft and fibrous material, so that a little powder can be taken out of the receptacle and then applied on the face.

PROBLEM RAISED

Cosmetic products designed to be packaged in cases are developing towards more and more complex formulations designed either to fulfill new functions, or to more efficiently fulfill known functions.

A problem arises in the case of formulations comprising a volatile product, since standard cases are not airtight. This problem is solved by the use of sealed receptacles inside the cases.

However, these cases with sealed receptacles are not easy to use to the extent that there are two covers, each with its hinge and its diametrically opposite closing device. Consequently, for reasons of compactness, the hinge and the closing device of the receptacle are oriented at 90° from the hinge and the closing device of the case. Thus, a person opening the case normally holds the case with one hand while the other hand lifts the case cover, and then finds a receptacle in which the closing device will be at his right or left so that he will need to change hands, for example if the free hand that opened the cover is the right hand whereas the closing device is at the left—or vice versa.

The invention is intended to solve this problem and to make a case with an airtight receptacle that can be adapted to any left handed or right handed person.

DESCRIPTION OF THE INVENTION

According to the invention, the case comprises a cover and a bottom fixed and hinged by means of a first hinge, a first closing device for the said cover, and contains a sealed receptacle comprising a bottom and side wall fitted with an airtight cover fitted with a second hinge and a second closing device, and is characterized in that:

a) the said receptacle is a receptacle that can be click fitted/separated in the said case by clipping means consisting of cooperation between male parts (typically ribs) and female parts (typically grooves), the ribs being formed on the wall of the said receptacle and the grooves being formed on the said bottom of the said case;

b) the said receptacle can be clipped such that the said second closing device can be in two different orientations from the said first closing device; such that the user of the said case can orient the said receptacle himself or herself with respect to the said case depending on whether he or she is right handed or left handed, to make it easier to open the said receptacle later.

DETAILED DESCRIPTION OF THE INVENTION

Figure 1:
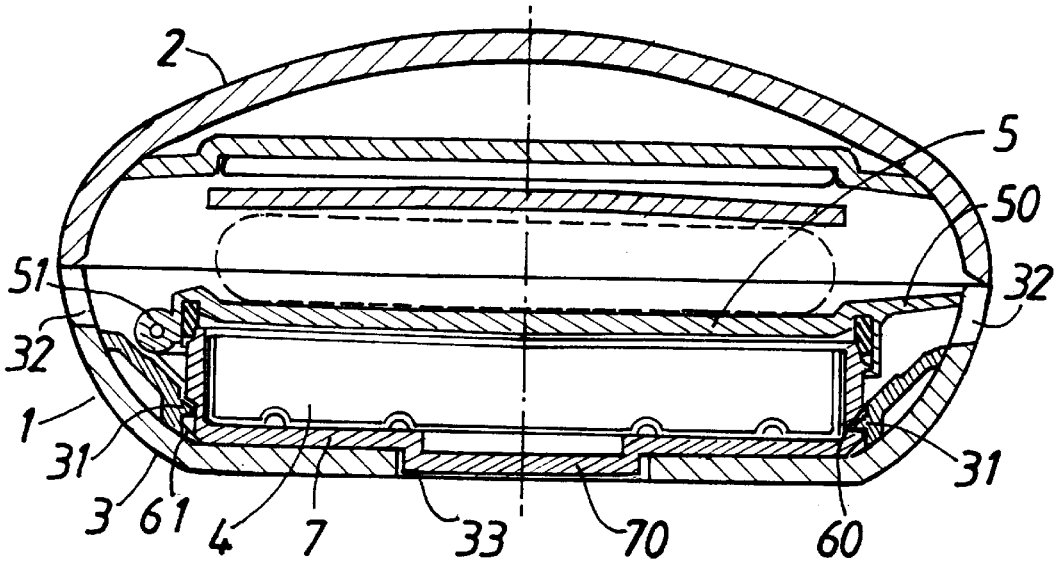
FIGS. 1 and 2 are views of cases (1) according to the invention, along a section through a vertical plane.
Figure 2:
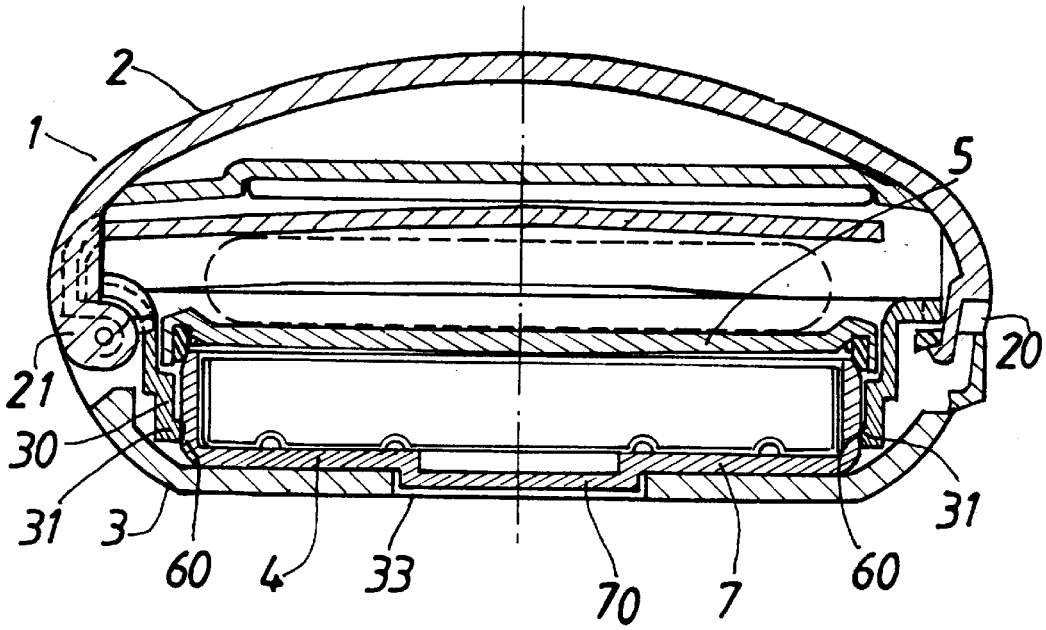

In the case (1) according to the invention, the bottom (3) of the case (1) has an orifice or opening (33) enabling manual contact with the bottom (7, 70) of the said receptacle (4) so as to exert the manual pressure necessary to facilitate separation of the said receptacle (4) as shown in FIGS. 1 and 2.

As illustrated in FIGS. 3*a*, 3*b* and 4*a*, 4*b*, the said receptacle (4) may be placed in two different orientations with respect to the said case (1), such that the B axis (52) formed by the said second hinge (51) and the said second closing device (50) of the said receptacle (4) forms a right angle with the axis A (22) formed by the said first hinge (21) and the said first closing device (20) of the said case (1) and in that the said second closing device (50) can be at 90° to the right or left of the said first closing device (20).

According to the invention, the bottom (3) of the case has two side clipping ribs (31) at 90° from the said A axis, a right rib and a left rib, and there is a hollowed out part (61) in the wall of the said receptacle adjacent to the said second hinge in which the said clipping rib fits, and there is a groove (60) adjacent to the said second closing device, that will cooperate with the said side clipping rib (31), such that when the said receptacle (4) is opened, the vertical force typically exerted on the second closing device (50) will not pull the said receptacle (4) outside the said case (1). If the bottom (3) of the case is formed by a plane bottom and a side wall, the two side clipping ribs (31) are fixed to the said side wall.

This embodiment is shown in FIG. 1, the right part of the figure showing how a rib (31) fits into a groove (60) formed on the side wall (6) of the receptacle adjacent to the closing device and underneath the closing device (50), whereas the left part of the figure shows a hollowed out part (61) under the hinge (51) that prevents the receptacle from engaging with the rib (31) facing the said hollowed out part. This facilitates intentional separation of the receptacle, and prevents accidental separation when the receptacle cover is opened.

Cooperation between the said grooves (60) and ribs (31) may be chosen such that the extraction force to extract the said receptacle (4) or to release the receptacle from the case in order to modify its orientation, is at least twice as high as the vertical force normally exerted to open the said sealed cover (5), which is usually between 3 and 10 N, and is less than the maximum force that the average user is prepared to apply (typically 50 N) in this type of situation, as a function of the number and depth of pairs of ribs and grooves.

Typically, the said bottom of the case is fitted with 4 clipping ribs (31) at 90° from each other, two being along the A axis, the said wall (6) of the said receptacle comprising two opposite grooves (60), each being at 90° from the said B axis, as can be seen on FIGS. 1 and 2.

According to one embodiment of the invention, the said bottom (3) may comprise a grid (30) clipped in the said bottom, the said grid forming the support of the said receptacle and on which the said male clipping parts, typically ribs (31), are fitted as illustrated in FIGS. 1 and 2.

According to another embodiment of the invention, the bottom (7) of the said receptacle comprises a shoulder with a lower part (70) penetrating at least partially into the said orifice or the said opening (33) in order to facilitate manual separation of the said receptacle.

This lower part (70) may have a section that cooperates with the section of the said orifice or the said opening, as illustrated in FIGS. 1 and 2.

Figure 5:
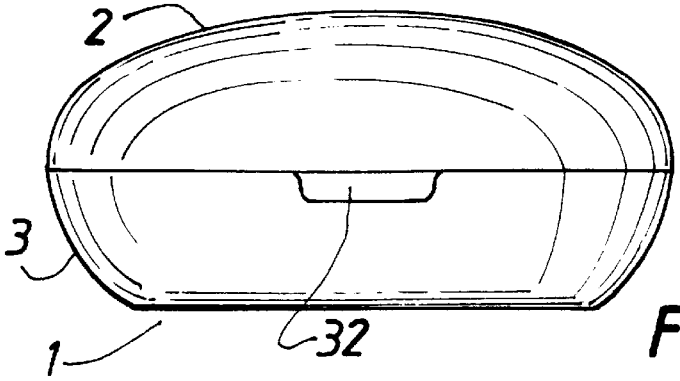
FIG. 5 is a side view of a case according to the invention.

As illustrated in FIG. 5, the side of the bottom (3) of the case may be provided with two recessed parts (32) oriented at 90° from the A axis in order to facilitate manual gripping of the said second closing device.

The invention is not limited to an arbitrary shape of the case. Therefore, this case may be of any shape whatsoever, typically round, square, rectangular, oval or oblong.

EXAMPLE EMBODIMENT

Cases were made using the elements in FIGS. 1 and 2.

Figure 3A:
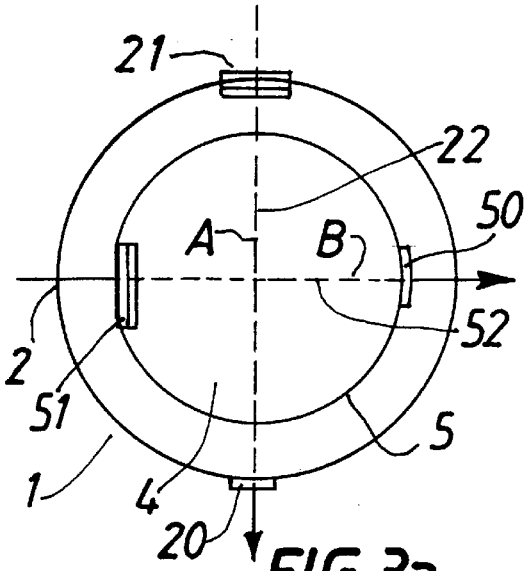
FIGS. 3 and 4 are diagrammatic views of the cases according to the invention, along a section through a horizontal plane.
Figure 3B:
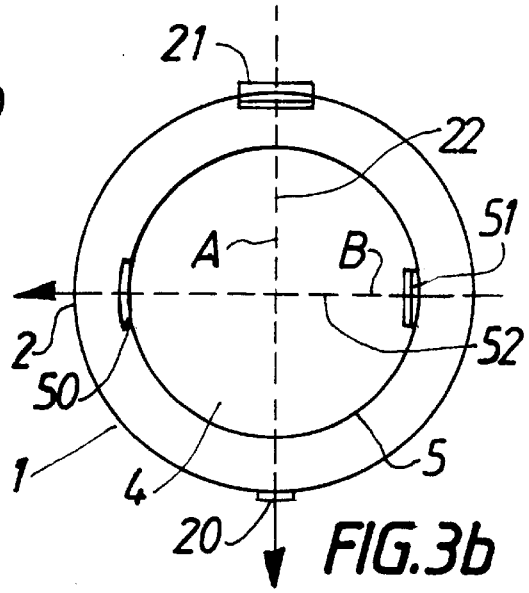
Figure 4A:
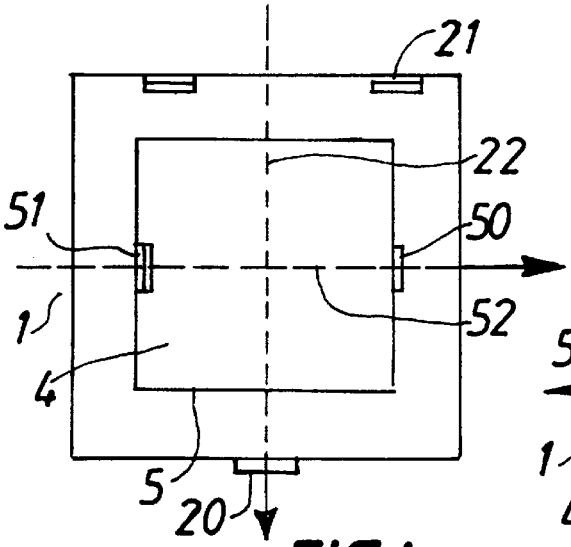
Figure 4B:
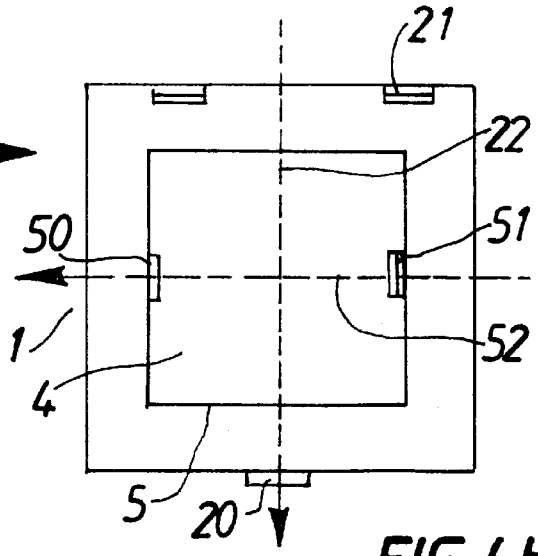

The shape of a section through the horizontal plane of these cases is round, corresponding to FIGS. 3*a* and 3*b*, and the shape of a section through the vertical plane is oval, as shown in FIGS. 1 and 2. The bottom (3) of the case is fitted with a grid (30) irreversibly clipped into the said bottom (3), the grid being fitted with 4 ribs (31) at 90° from each other, and acting as a support to the said receptacle.

The side of the bottom (3) of the case (1) has two recessed parts (32) along the B axis of the receptacle as shown in FIG. 5.

The diameter of the receptacle (5) is 50.8 mm and its height is 7 mm.

It has a rib (60) under the closing device, two side ribs on each side at 90°, and a hollowed out part (61) under the closing device.

The bottom (7) of the receptacle has a lower part (70) adapted to the shape of the 20 mm diameter opening (33) located in the lower part of the said bottom (3).

Users (particularly left-handed users) evaluated the ease of opening the receptacle using cases according to the invention and the ease of reorienting the receptacle if required, in comparative tests carried out on standard cases according to the state of the art and on cases according to the invention, and recognized that this ease of use was advantageous.

Advantages of the Invention

The invention solves a problem for left-handed persons that has not been solved in the past, in a very practical and sensible manner at no extra cost, since cases with receptacles are usually made to be opened by right-handed persons.

| Marks used | |
|---|---|
| CASE | 1 |
| COVER | 2 |
| FIRST CLOSING DEVICE | 20 |
| FIRST HINGE PORTION | 21 |
| AXE A | 22 |
| BOTTOM | 3 |
| GRID | 30 |
| CLIPPING MALE ELEMENT | 31 |
| RECESS PART | 32 |
| OPENING | 33 |
| RECEPTACLE | 4 |
| COVER | 5 |
| SECOND CLOSING DEVICE | 50 |
| SECOND HINGE PORTION | 51 |
| AXE B | 52 |
| SIDE WALL | 6 |
| CLIPPING FEMALE ELEMENT | 60 |
| RECESS UNDER HINGE | 61 |
| BOTTOM | 7 |
| LOWER PART | 70 |

What is claimed is:

1. Case (1) comprising a cover (2) and a bottom (3) fixed and hinged by means of a first hinge (21), a first closing device (20) for said cover (2), and containing a sealed receptacle (4) comprising a bottom (7) and a side wall (6) fitted with an airtight cover (5) fitted with a second hinge (51) and a second closing device (50), said case having an A axis running through said first closing device and dividing said case into first and second halves and a B axis normal to said A axis and running through said second closing device, characterized in that:

a) said receptacle (4) is a receptacle that can be click fitted/separated in said case (1) by clipping means comprising male parts (31) (typically ribs) and female parts (typically grooves) facing said ribs, said ribs being formed on the wall (6) of said receptacle and the grooves being formed on said bottom (3) of said case;

b) said receptacle (4) can be clipped such that said second closing device (50) can be in two different orientations from said first closing device (20); and, c) said receptacle is provided with a hollowed out part (61), typically adjacent to said hinge (51), that prevents said receptacle from getting engaged with a male clipping part on said case, in order to facilitate intentional separation of said receptacle.

2. Case according to claim 1, in which the said bottom (3) of case is provided with an orifice or opening (33) that enables manual contact with the bottom (7, 70) of said receptacle (4), so that manual pressure can be exerted to enable and facilitate separation of said receptacle (4).

3. Case according to claim 2 in which said receptacle (4) may be oriented at two angles with respect to said case (1), such that the B axis formed by said second hinge (51) and said second closing device (50) of said receptacle (4) forms a right angle with the A axis formed by said first hinge (21) and said first closing device (20) of said case (1), and that said second closing device (50) may thus be located at 90° to the right or left of said first closing device (20).

4. Case (1) comprising a cover (2) and a bottom (3) fixed and hinged by means of a first hinge (21), a first closing device (20) for said cover (2), and containing a sealed receptacle (4) comprising a bottom (7) and a side wall (6) fitted with an airtight cover (5) fitted with a second hinge (51) and a second closing device (50), said case having an A axis running through said first closing device and dividing said case into first and second halves and a B axis normal to said A axis and running through said second closing device, characterized in that:

a) said receptacle (4) is a receptacle that can be click fitted/separated in said case (1) by clipping means comprising male Tarts (31) (typically ribs) and female parts (typically grooves) facing said ribs, said ribs being formed on the wall (6) of said receptacle and the grooves being formed on said bottom (3) of said case;

b) said receptacle (4) can be clipped such that said second closing device (50) can be in two different orientations from said first closing device (20); and, c) said receptacle is provided with a hollowed out part (61), typically adjacent to said hinge (51), that prevents said receptacle from getting engaged with a male clipping part on said case, in order to facilitate intentional separation of said receptacle, and wherein said bottom (3) of the case has two side clipping ribs (31) located at 90° from said A axis, a right groove and a left groove, and in which the wall of said receptacle has a groove (60) adjacent to said second closing device, designed to cooperate with said side clipping rib (31), such that the typically vertical force exerted on said second closing device (50) does not pull said receptacle 4 out of said case 1, when said receptacle 4 is opened.

5. Case according to claim 4 in which the number and depth of the pairs of said cooperating grooves (60) and ribs (31) is chosen such that the force to extract said receptacle (4) or to separate the receptacle from the case in order to modify its orientation, is equal to at least twice the vertical force normally exerted to open said airtight cover (5), and is less than the maximum force that the average user is prepared to exert.

6. Case according to claim 5 in which said bottom of the case has four clipping ribs (31) at 90° from each other, two being along the A axis, and in which said wall (6) of the said receptacle has two opposite grooves (60), each groove being at 90° from said B axis.

7. Case (1) comprising a cover (2) and a bottom (3) fixed and hinged by means of a first hinge (21), a first closing device (20) for said cover (2), and containing a sealed receptacle (4) comprising a bottom (7) and a side wall (6) fitted with an airtight cover (5) fitted with a second hinge (51) and a second closing device (50), said case having an A axis running through said first closing device and dividing said case into first and second halves and a B axis normal to said A axis and running through said second closing device, characterized in that:

a) said receptacle (4) is a receptacle that can be click fitted/separated in said case (1) by clipping means comprising male parts (31) (typically ribs) and female parts (typically grooves) facing said ribs, said ribs being formed on the wall (6) of said receptacle and the grooves being formed on said bottom (3) of said case;

b) said receptacle (4) can be clipped such that said second closing device (50) can be in two different orientations from said first closing device (20); and, c) said receptacle is provided with a hollowed out part (61), typically adjacent to said hinge (51), that prevents said receptacle from getting engaged with a male clipping part on said case, in order to facilitate intentional separation of said receptacle, and wherein said bottom (3) comprises a grid (30) clipped in said bottom, said grid forming the support of said receptacle and carrying said male clipping parts, typically ribs.

8. Case according to claim 1, in which the bottom (7) of said receptacle is fitted with a shoulder with a lower part (70) penetrating at least partially into said orifice or said opening (33), to facilitate manual separation of said receptacle.

9. Case according to claim 8 in which said lower part (70) is fitted with a section cooperating with the section of the said orifice or said opening.

10. Case according to claim 1 in which the side of the bottom (3) of the case has two recessed parts (32) at 90° from A axis, to facilitate manual gripping of the said second closing device.

11. Case according to claim 1, of any shape whatsoever and typically round, square, rectangular, oval or oblong.

* * * * *